US007066637B2

(12) United States Patent
Nozawa et al.

(10) Patent No.: US 7,066,637 B2
(45) Date of Patent: Jun. 27, 2006

(54) IMITATION FLAME GENERATING APPARATUS AND METHOD

(75) Inventors: Hiroshi Nozawa, Nagano (JP); Noriyuki Matsuo, Tokyo (JP)

(73) Assignees: ChAotic Toys Factory Ltd., Tokyo (JP); Honda Tsushin Kogyo Co., Ltd., Tokyo (JP); Asiacorp International Limited, Kowloon (HK)

( * ) Notice: Subject to any disclaimer, the term of this patent is extended or adjusted under 35 U.S.C. 154(b) by 48 days.

(21) Appl. No.: 10/879,156

(22) Filed: Jun. 30, 2004

(65) Prior Publication Data

US 2005/0007779 A1 Jan. 13, 2005

(30) Foreign Application Priority Data

Jul. 7, 2003 (JP) ..... 2003-271587

(51) Int. Cl.
*F21V 35/00* (2006.01)

(52) U.S. Cl. ..... 362/810; 362/806; 362/800

(58) Field of Classification Search ..... None
See application file for complete search history.

(56) References Cited

U.S. PATENT DOCUMENTS 5,924,784 A * 7/1999 Chliwnyj et al. ..... 362/234
6,688,752 B1 * 2/2004 Moore ..... 362/234
2001/0022586 A1 * 9/2001 Hino et al. ..... 345/473
2001/0033488 A1 * 10/2001 Chliwnyj et al. ..... 362/231
2004/0196658 A1 * 10/2004 Fung ..... 362/392
2004/0223326 A1 * 11/2004 Wainwright ..... 362/231

FOREIGN PATENT DOCUMENTS

| | | |
|---|---|---|
| JP | 08-180977 | 7/1996 |
| JP | 09-106890 | 4/1997 |
| JP | 2000-021210 | 1/2000 |
| JP | 2000-245617 | 9/2000 |
| JP | 2002-334606 | 11/2002 |

* cited by examiner

*Primary Examiner*—Tuyet Thi Vo
(74) *Attorney, Agent, or Firm*—Dickstein Shapiro Morin & Oshinsky LLP

(57) ABSTRACT

A space that closely approximates the state of an actual flame is reproduced without depending on temporal periods. Namely, by reproducing a spatiotemporal pattern of a flame, the light source can be caused to emit warm light, whereby a compact and inexpensive imitation flame generating apparatus is provided. The imitation flame generating apparatus 1 comprises a light source 10 and a control device 40 for controlling the output of electric current to the light source 10. The control device 40 comprises computation means 41 for computing a spatiotemporal pattern of the flame using a coupled map lattice, and output means 42 for outputting the electric current in accordance with the thus computed spatiotemporal pattern of the flame.

8 Claims, 11 Drawing Sheets

(a)

(b)

IMITATION FLAME GENERATING APPARATUS AND METHOD

BACKGROUND OF THE INVENTION

1. Field of the Invention

The present invention relates to an imitation flame generating apparatus, and more particularly to an imitation flame generating apparatus in which the change of field variables relating to an appropriately coarse graining flame is computed using a coupled map lattice associated with the space in which the flame is represented.

2. Background Art

The operation of an illumination light source by varying the current supplied to the light source in order to electrically simulate the flickering of a candle light, for example, is generally known. There are various methods of varying the current. One of the most general methods is employed in an atmosphere-producing lighting apparatus in which light sources, such as light-emitting diodes, are supplied with a current that varies at certain periods over time (see, for example, Patent Document 1). An electric candle in which a lighting member is blinked using a random signal generating device, so that an irregular, rather than periodic, light can be obtained (see, for example, Patent Document 2) is also known. An illuminating device is also known in which, in order to obtain a more comfortable lighting condition by taking advantage of the 1/f fluctuation properties, an output waveform is generated using a 1/f filter, and a varying signal obtained by a wind velocity sensor is given to the output waveform (see, for example, Patent Document 3).

In another method of expressing the flickering of a flame, a religious device employs a flickering light member. In this method, an actual flame is subjected to chaotic analysis based on chaos theory on a personal computer in advance, and data with values relatively close to those of the flame is created and stored in a memory device. Then, LEDs are turned on using the thus stored chaotic data in a repeated manner (see, for example, Patent Document 4). In another example, an illuminating device comprises a plurality of light sources arranged in a manner resembling a candle flame. The amount of light emitted by each light source is varied based on a plurality of pieces of data stored in a memory device in advance, such that the flickering of the flame can be simulated (see, for example, Patent Document 5)

(Patent Document 1) JP Patent Publication (Kokai) No. 2002-334606 A (Patent Document 2) JP Patent Publication (Kokai) No. 2000-21210 A (Patent Document 3) JP Patent Publication (Kokai) No. 8-180977 A (1996)

(Patent Document 4) JP Patent Publication (Kokai) No. 2000-245617 A (Patent Document 5) JP Patent Publication (Kokai) No. 9-106890 A (1997)

SUMMARY OF THE INVENTION

The light produced by the lighting apparatus that emits light with periodicity is monotonous. Randomly emitted illumination is quite dissimilar from the actual, flickering light produced by a lit candle. The lighting apparatus that emits light with a 1/f fluctuation merely operates the light source at 1/f periods, which is a characteristic obtained by arranging the power spectrum using a temporal frequency component. Thus, in this apparatus, it cannot be said that actual combustion is accurately represented. Further, in the apparatus comprising a plurality of light sources that utilize the 1/f fluctuation, since the light sources are turned on with the same timing without mutually influencing one another, and since the flame is expressed in a virtual space, the peculiar warmth of a flame in a real space cannot be produced in the virtual space even if the light sources have different amounts of light.

In yet another example of an illuminating apparatus, a light source is operated in accordance with data based on physical property changes in natural phenomena (such as the flickering of flame or sound). In this apparatus, since the captured data is used in a repetitive manner, the data is periodic in the long run such that it cannot be said that the flickering of a flame, which is irregular, is accurately reproduced. Particularly, where chaotic analysis is employed, the analysis is based on a temporal topological space, which means that the light source is turned on using time as a variable. In this case, only temporal fluctuation is expressed and a flame in a real space is not expressed. Thus, when a plurality of light sources are turned on, although they vary in time, they cannot be turned on such that one light source influences another. Further, in order to accurately simulate a flame, a large data storage volume must be provided, which would lead to an increase in the size of the apparatus and in manufacturing cost.

In view of the aforementioned problems of the prior art, it is the object of the invention to provide a compact and inexpensive imitation flame generating apparatus capable of emitting warm light by reproducing a space that is extremely close to an actual flame, i.e., reproducing the spatiotemporal pattern of a flame, without depending on temporal periods.

In order to achieve this object, the invention provides an imitation flame generating apparatus comprising a light source and a control device for controlling the output of an electric current to the light source. The control device comprises a computing means for computing a spatiotemporal pattern of a flame using a coupled map lattice, and an output means for outputting the electric current in accordance with the computed spatiotemporal pattern of the flame.

Preferably, the coupled map lattice may comprise a field variable relating to an appropriately coarse graining flame, and said computation means comprises a procedure for computing said field variable relating to the flame using a control parameter.

Preferably, the field variable relating to the flame may comprise a substance amount, an internal energy amount, and a momentum, and the computing procedure may comprise a procedure for computing combustion, a procedure for computing expansion, and a procedure for computing diffusion.

Preferably, the computing means may compute the spatiotemporal pattern of the flame based on the combustion computation procedure, the expansion computation procedure, and the diffusion computation procedure.

The computation means may be capable of inputting and changing the field variable relating to the flame and/or the control parameter.

The invention also provides an imitation flame generating method for generating an imitation flame by controlling an electric current supplied to a light source. The method comprises computing a spatiotemporal pattern of a flame for generating an imitation flame using a coupled map lattice, and supplying the output current in accordance with the thus computed spatiotemporal pattern of a flame to turn on said light source.

Preferably, the coupled map lattice may comprise a field variable relating to an appropriately coarse graining flame, and said computation comprises a procedure for computing the field variable relating to the flame using a control parameter.

Preferably, the field variable relating to the flame may comprise a substance amount, an internal energy amount, and a momentum, and the computing procedure may comprise a procedure for computing combustion, a procedure for computing expansion, and a procedure for computing diffusion.

The computation may involve the computation of the spatiotemporal pattern of the flame using the combustion computation procedure, the expansion computation procedure, and the diffusion computation procedure.

The field variable relating to the flame and/or the control parameter may be inputted and changed during the computation.

In accordance with the imitation flame generating apparatus of the invention, it is possible to reproduce a space that extremely resembles the state of an actual flame, namely, imitate the spatiotemporal pattern of the flame, without depending on temporal periods. The adjacent light sources can be caused to emit light such that they affect each other, such that the individual light sources can emit light in a natural manner and, when the light sources are viewed as a whole, they can emit warm light resembling an actual flame. Moreover, as the invention is based on computations that capture the dynamic thermal-hydraulic phenomenon, the light sources can emit light that resembles the actual flame.

The physical values as initial values indicating the conditions of the field variables relating to a flame can be entered during the computation. Various types of flame can be represented in accordance with the surrounding environments in a real-time manner. Moreover, the light sources can be controlled in a real-time manner such that an effect similar to the flame flickering due to a breeze or other external influences can be provided.

As the invention allows a flame to be reproduced without burning matter, it can provide an effective lighting source that is safe and environmentally friendly.

BRIEF DESCRIPTION OF THE DRAWINGS

FIG. 6(*a*) shows a lattice divided into groups, and FIG. 6(*b*) shows the arrangement of the light sources corresponding to the lattice groups.

DESCRIPTION OF THE PREFERRED EMBODIMENTS

Figure 1:
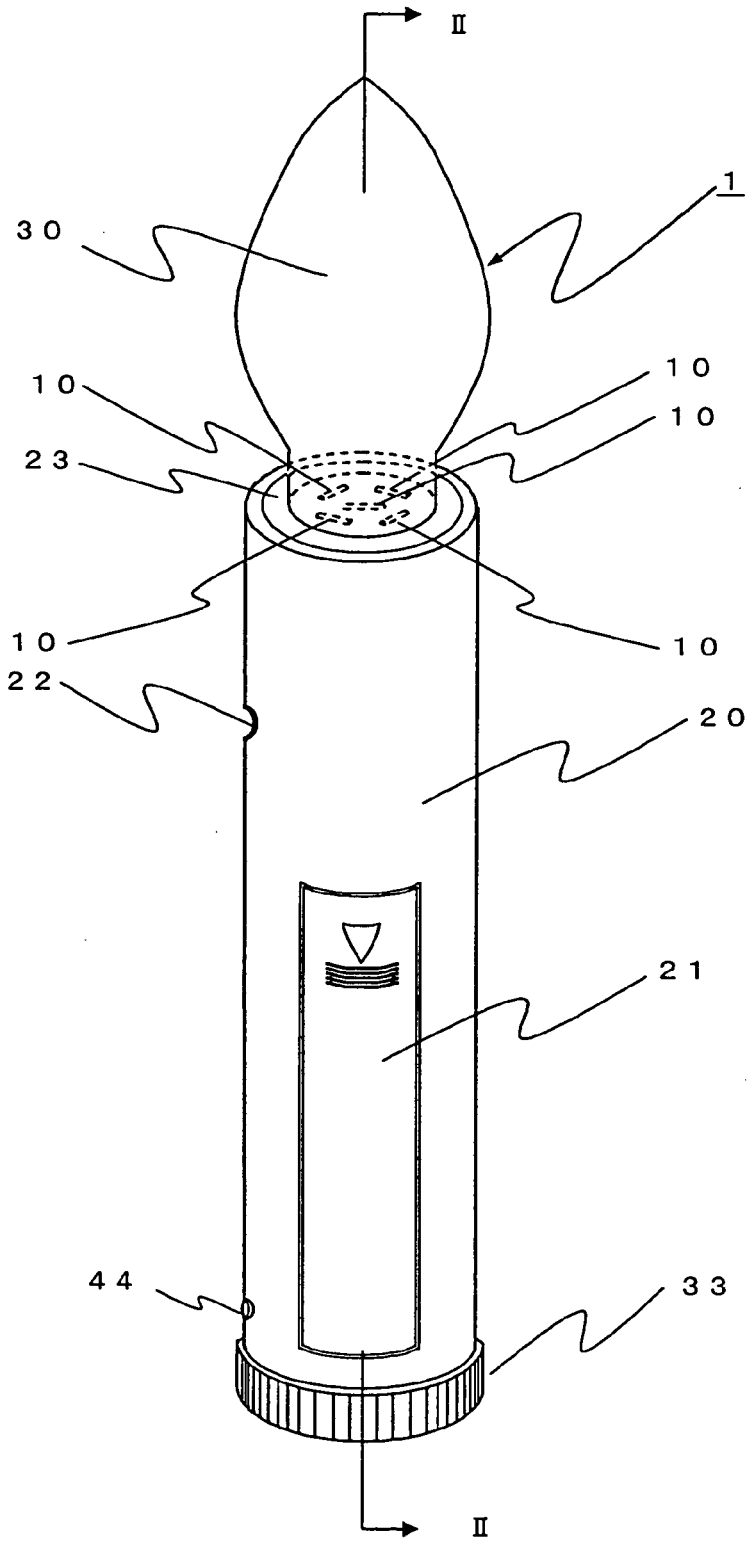
FIG. 1 shows a perspective view of an imitation flame generating apparatus according to an embodiment of the invention.

An imitation flame generating apparatus 1 according to an embodiment of the present invention will be described by referring to the drawings. FIG. 1 shows a perspective view of the imitation flame generating apparatus 1 of the present embodiment, and FIG. 2 shows a cross section taken along line II—II of FIG. 1.

Figure 2:
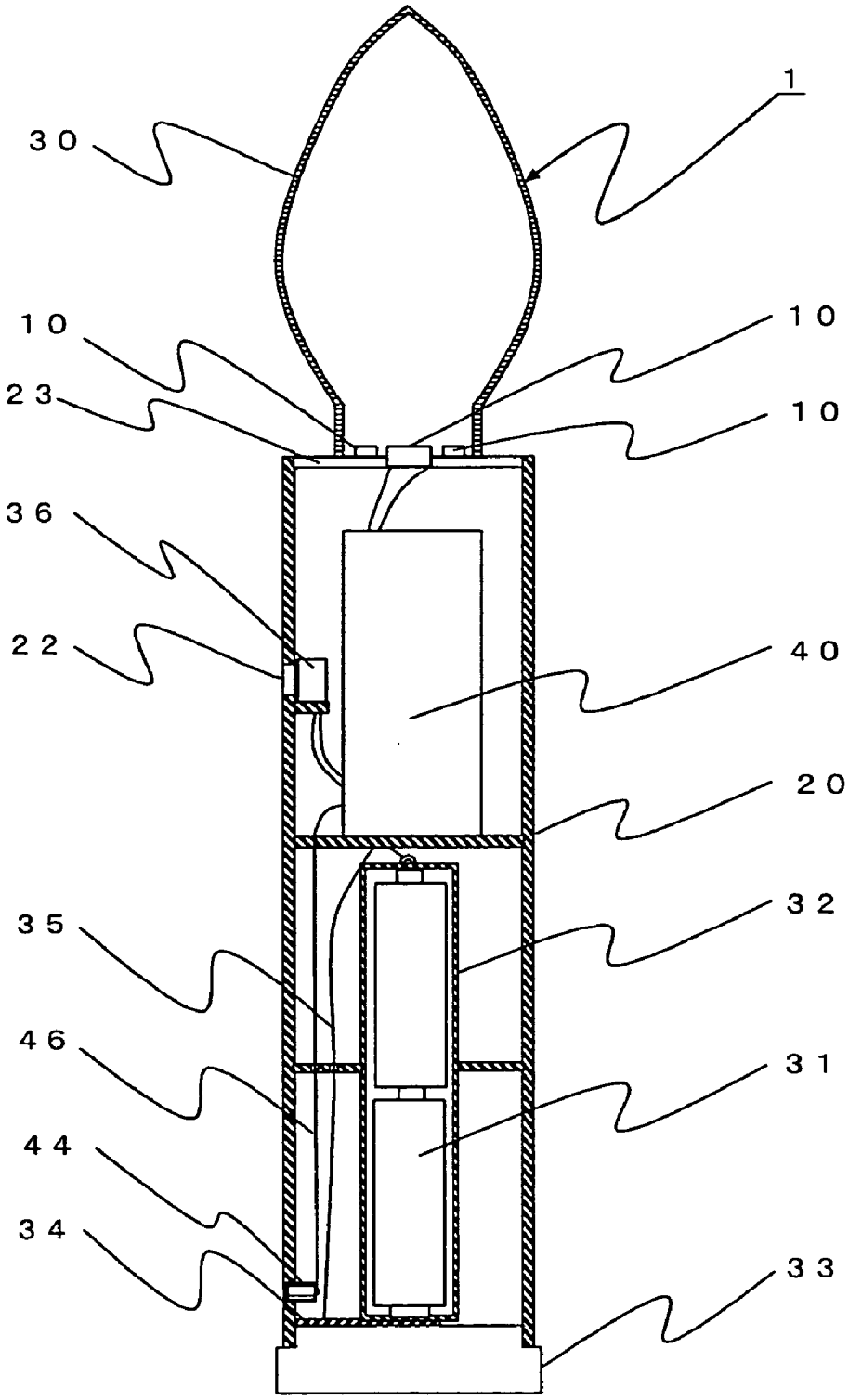
FIG. 2 shows a cross section taken along line II—II of FIG. 1.

Referring to FIGS. 1 and 2, the imitation flame generating apparatus 1, which is an apparatus for reproducing a lit candle, includes a holding case 20 which is hollow and cylindrical in shape, and an imitation flame portion 30 which is similar in shape to an actual flame and has a cream-colored internal bore. The holding case 20 is bonded to the imitation flame portion 30 with an adhesive or the like. A circular, light-source mount plate 23 is bonded to one end of the holding case 20 with an adhesive or the like. On the surface of the light-source mount plate 23, five light sources 10 employing LEDs, for example, are mounted, of which one is disposed at center and the remaining four are disposed around the central light source at equal intervals. On the other end of the holding case 20, a light switch 33 for turning on the light sources 10 is mounted in a rotatable manner.

The holding case 20 further includes a through hole 22 providing communication between the inside and the outside, and a sliding cover 21 allowing for the insertion and extraction of a battery 31 in a battery box 32 provided inside the casing. In addition to the battery 31, there are further provided in the holding case 20 a control device 40, a voice detection sensor 36 disposed facing toward the through hole 22, and an input terminal 44 for allowing for the input of data from an external input device (not shown), via a wire 46, to the control device 40. As the light switch 33 is rotated, a terminal 34 comes into electrical contact with a wire 35 that is fixed to the holding case 20, thereby allowing an electric power to be supplied from the battery 31 to the control device 40. The voice detection sensor 36 and each light source 10 are electrically connected to the control device 40 so that they can send and receive signals between one another.

Figure 3:
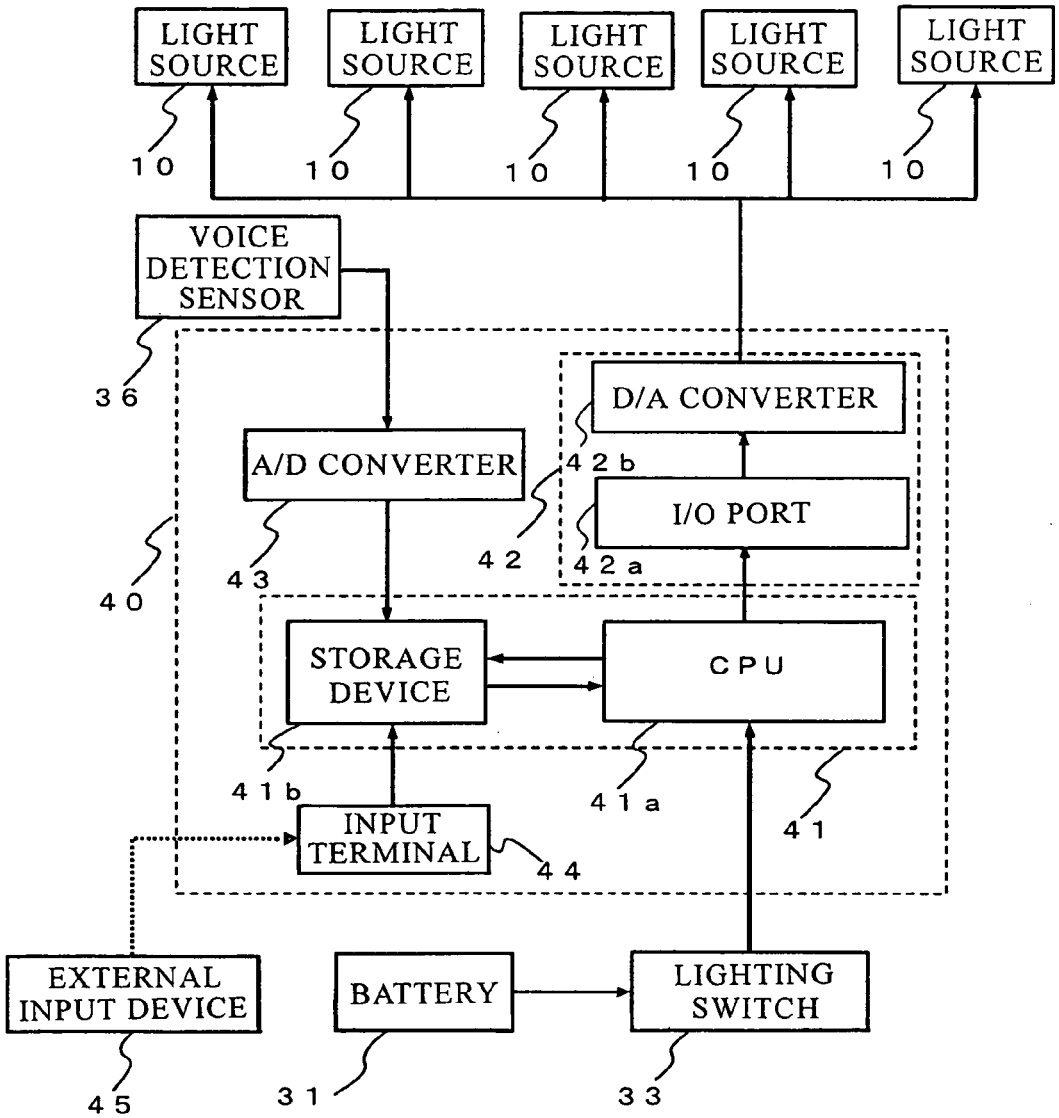
FIG. 3 shows a control block diagram of the imitation flame generating apparatus according to the embodiment of the invention.

FIG. 3 shows a control block diagram of the internal configuration of the imitation flame generating apparatus 1 of the present embodiment, which includes the light source 10, battery 31, light switch 33, control device 40 comprising a computing means 41 and an output means 42, and the voice detection sensor 36. As the light switch is turned on, power is supplied from the battery 31 to the control device 40. Based on signals inputted from the voice detection sensor 36 and the external input device 45, which is located outside the imitation flame generating apparatus 1, the control device 40 performs computations to simulate the flame and controls the output of an electric current to the light sources 10 that are turned on. The external input device 45, which is provided outside the imitation flame generating apparatus 1 in the present embodiment, may be provided inside the imitation flame generating apparatus 1.

The computation means 41 includes a CPU 41*a* and a memory device 41*b*. The output means 42 includes an I/O port 42*a* and a D/A converter 42*b*. In the memory device 41*b*, there are stored procedures for computing the field variables relating to the flame, using control parameters, in order to simulate the flame.

Specifically, in the memory device 41*b*, there are stored a combustion computation procedure, an expansion computation procedure, and a diffusion computation procedure. The CPU 41*a* reads the control parameters indicating the state of the flame and the field variables relating to the flame (which will be described later), which are inputted to the memory device 41*b* from the external input device 45 via the input terminal 44. In accordance with these procedures, the CPU 41*a* repetitively performs computations concerning the change of the field variables relating to a coarse graining flame.

The external input device is capable of freely changing the control parameters and the field variables relating to the flame during the computation in accordance with the particular type of flame to be simulated. CPU 41*a* can perform computations based on such a change and change the lighting condition of each light source 10 in a real-time manner.

In addition, after a measurement signal measured by the voice detection sensor 36 is inputted to the A/D converter 43, converted measurement data is stored in the memory device 41*b*. The voice detection sensor 36 is a sensor for detecting the external environment, and it is adapted to detect sound in a certain high frequency region such that it can detect the speed of wind around the imitation flame generating apparatus 1 based on the sound of wind. CPU 41*a* reads the obtained measurement data from the memory device 41*b* with a suitable timing during the repetitive computations and then incorporates them into the computations as the field variables (velocity field in the present case) relating to the flame. Thus, by appropriately detecting the external environment and incorporating it into computations in the form of field variables relating to the flame, any external change can be incorporated on a real-time basis.

The D/A converter 42*b* in the control device 40 processes from digital data via the I/O port 42*a* to analog data, and then the control device 40 supplies an output current to each of the light sources 10 in order to turn them on, via the I/O port 42*a*. The output means 42 may include an operational amplifier for amplifying the signal. Because the output current is determined on the basis of a table of the relationships between current values and light amounts that have been measured in advance, the light sources can emit an amount of light that is close to the amount of light of a candle.

Figure 4:
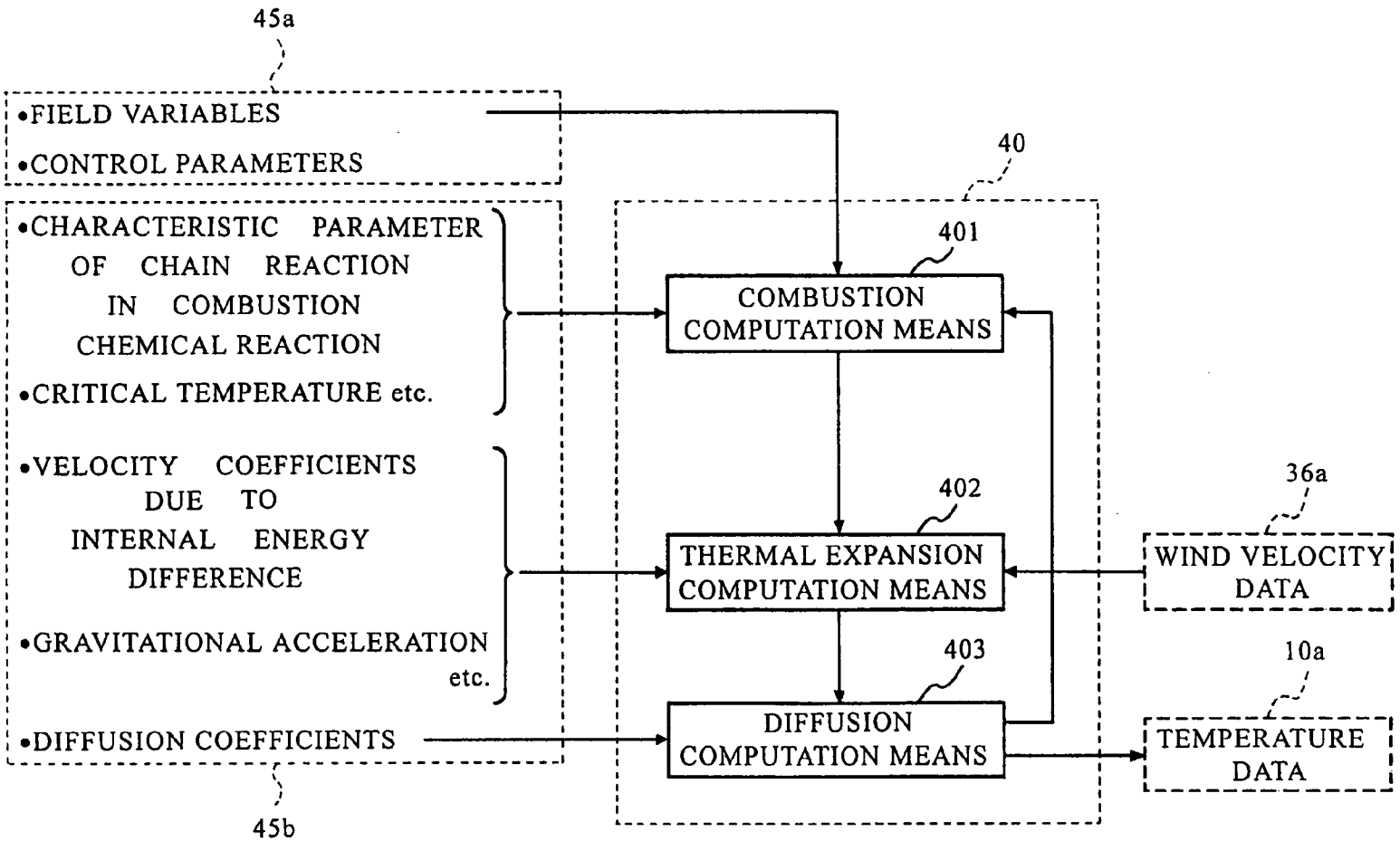
FIG. 4 shows the configuration of CPU in the imitation flame generating apparatus according to the embodiment.

FIG. 4 shows the software configuration of the computation means 40 in the imitation flame generating apparatus 1 in the present embodiment. The computation means 40 consists of a combustion computation means 401, a thermal expansion computation means 402, and a diffusion computation means 403. Computations are performed as these means are sequentially operated. Field variables 45*a* relating to the flame and control parameters 45*b*, which determine the spatiotemporal pattern of the flame, are suitably inputted from the external input device 45 to the individual computations means 401 to 403 constituting the computation means 41. After the light sources are turned on, wind velocity data 36*a*, which constitutes data about field variables (velocity field) relating to the flame that are detected by the voice detection sensor 36, is inputted to the computation means. The computation means then outputs temperature data 10*a*, which constitutes an output signal to each light source 10. In the illustrated example, although the wind data is inputted to the thermal-expansion computation means 402 and the temperature data is outputted from the diffusion computation means 403, this is only an example, and other circuits may be employed for data input and output.

The content of the computations performed by the individual computation means will be briefly described. The combustion computation means 401 computes the process representing the combustion of matter. Specifically, it computes the process in which, in the presence of sufficient energy to chemically react with the fuel present in each lattice (lattice to which field variables relating to an appropriately coarse graining flame are given), which will be described later, and the oxygen in the air, carbon dioxide and vapor are produced, generating energy. In the present example, in particular, an increase or decrease in the number of molecules is computed based on the chemical reaction involving the fuel, and the energy generated by this chemical reaction is computed.

The expansion computation means 402 computes the process representing the distribution of matter present in regions with different energy levels. Specifically, it computes the process in which, as a thermal expansion velocity (velocity which contributes to expansion) is created in the field variables relating to the flame by the energy generated in each lattice due to combustion, for example, some of the field variables relating to the flame in each lattice move to adjacent, surrounding lattices. In particular, the thermal expansion velocity is assumed to be created from a higher energy towards a lower energy (in an one direction), and the computation that takes the positional energy due to gravity into account.

The diffusion computation means 403 performs computations representing the process in which, in a space with molecular density differences, the molecules diffuse in an attempt to achieve homogeneity. Namely, the process represents the phenomena whereby, as irregularities are created in the density of the molecules distributed in the individual lattices due to the post-combustion expansion, the adjacent molecules with density are diffused uniformly.

The expansion computation means reads the wind velocity data 36*a*, which is external data, and then computes the movement of molecules and/or their energy change in a particular space due to the influence of wind.

Thus, in order to represent the flame, it is important to capture a change in the field variables relating to the flame due to combustion, a change in the field variables relating to the flame due to expansion, and a change in the field variables relating to the flame due to diffusion. By computing these changes, the physical phenomena for representing the flame can be precisely understood and the flame can be accurately reproduced.

By inputting appropriate control parameters 45*b*, a variety of types of flame, such as the flame of a candle or an alcohol lamp (where methanol is burned), can be reproduced. Thus, by setting initial data 52 using the external input device 45 via the input terminal 44, various flame patterns can be reproduced. The control parameters 45*b* can be changed during computation, and by so doing, the output condition of the light sources can be dynamically changed on a real-time basis. Moreover, by appropriately detecting the external environment and incorporating the wind velocity data, as a velocity field, into the field variables relating to the flame that are being calculated, external changes can be incorporated on a real-time basis.

Figure 5:
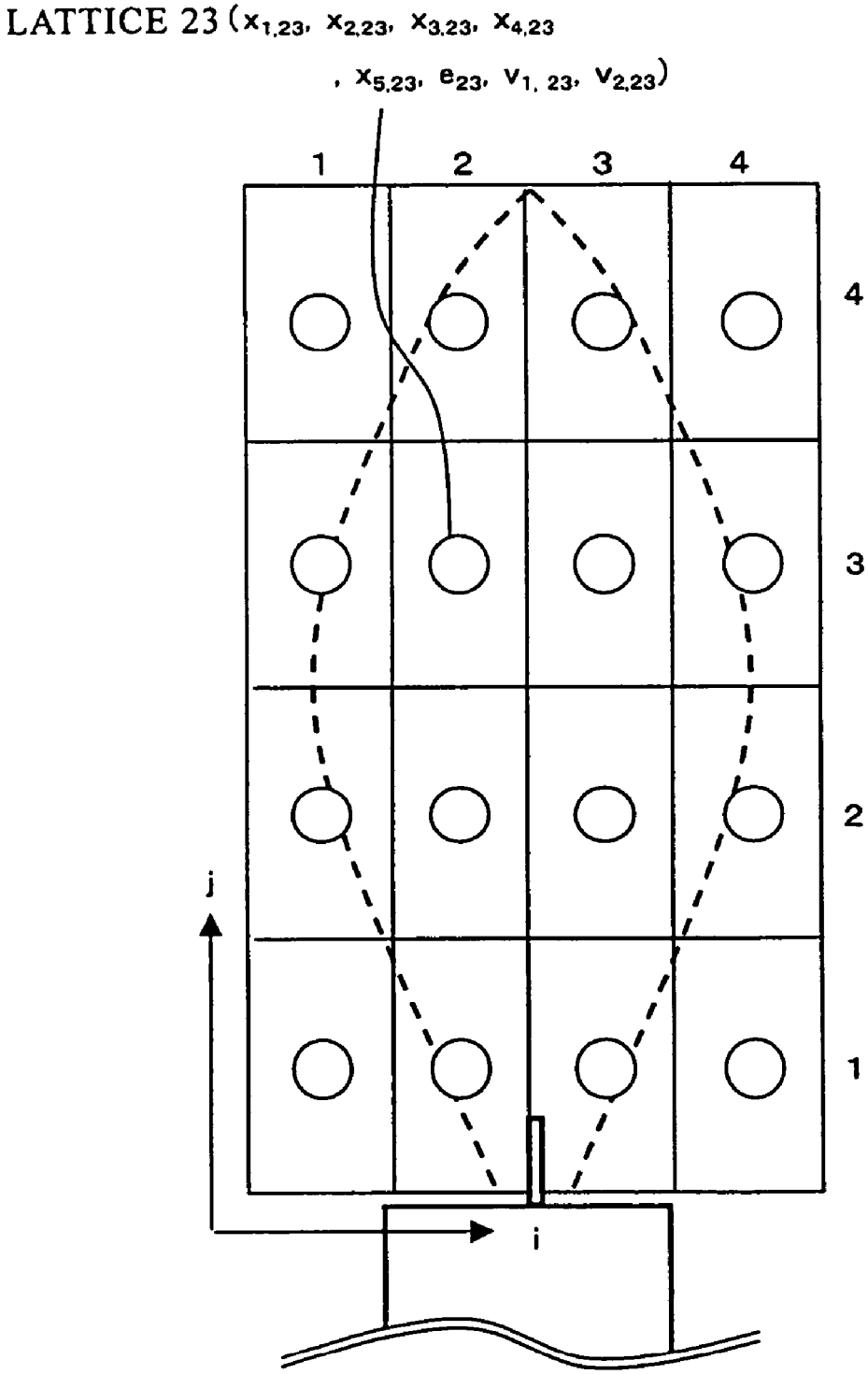
FIG. 5 shows a coupled map lattice of a candle flame in the imitation flame generating apparatus according to the embodiment.

FIG. 5 shows a coupled map lattice that is computed by the control device 40 of the imitation flame generating apparatus 1 according to the present embodiment. The coupled map lattice consists of field variables relating to an appropriately coarse graining flame, and procedures for computing the field variables relating to the flame. Specifically, in order to compute the change of the field variables relating to the appropriately coarse graining flame, divided spaces obtained by appropriately dividing a real space in which a flame is present are provided with, as the field quantities relating to the flame, appropriately coarse graining physical quantities, such as molecules, energy, or momentum (velocity), that exist in the divided spaces. Then, computations are performed that take into consideration the interaction between the field variables relating to the flame and the adjacent field variables relating to the flame with the elapse of time.

More specifically, the dashed line in FIG. 5 indicates, in a two-dimensional real space, the shape of the flame of an actual candle that is being burned. In order to represent the details of the candle flame, a space representing the burning flame is divided into 16 elements using a mesh of 4.times.4 rows and columns, and each element is allocated with a lattice. These lattices are defined as 16 field variables relating to the flame whereby the molecules in the space are coarse graining. The lattices are represented in the mesh as the field variables relating to an appropriately coarse graining flame, and in order to represent the states within the mesh, the field variables relating to the flame are allocated in the lattices. Although the shape of the flame is represented in a two-dimensional real space, the number of dimensions is not particularly limited and may be three, for example. The number of the elements in the mesh is not particularly limited either.

A lattice at row i and column j is designated lattice ij. The field variables relating to the flame consist of the substance amount of oxygen molecules, the substance amount of fuel molecules, the substance amount of carbon dioxide molecules, the substance amount of vapor molecules, the substance amount of nitrogen molecules, the internal energy, the i-direction velocity, and the j-direction velocity. These field variables relating to the flame are designated as $x_{1,ij}$, $x_{2,ij}$, $x_{3,ij}$, $x_{4,ij}$, $x_{5,ij}$, $e_{ij}$, $v_{1,ij}$, and $v_{2,ij}$, respectively. In FIG. 5, the physical quantities possessed by the lattices 23 with i=2 and j=3, namely, field variables relating to the flame ($x_{1,23}$, $x_{2,23}$, $x_{3,23}$, $x_{4,23}$, $x_{5,23}$, $e_{23}$, $v_{1,23}$, and $v_{2,23}$), are indicated. Based on these field variables relating to the flame, temperature changes in each lattice are computed on a real-time basis, and the light sources are turned on in accordance with the thus computed temperatures $h_{ij}$. While in the illustrated example the field variables relating to the flame consist of the substance amounts of oxygen, fuel, carbon dioxide, vapor, and nitrogen, other substance amounts may be given in accordance with the assumed combustion environment.

From these field variables relating to the flame, variables such as a total substance amount $n_{ij}$, mass $m_{ij}$, temperature $h_{ij}$, and momentum $p_{ij}$ can be derived. Namely, the total substance amount $n_{ij}$ that exists in the lattice ij is the value of the sum of the molecular substance amount of each molecule. The mass $m_{ij}$ that exists in the lattice ij has a value corresponding to the sum total of the products of the aforementioned five molecular substance amounts and each molecular amount. The temperature $h_{ij}$ in the lattice ij, which constitutes the output data in the present example, is the value obtained by dividing the internal energy $e_{ij}$ by the total substance amount $n_{ij}$. The momentum $p_{ij}$ in the lattice ij is the value of the product of the mass $m_{ij}$ and the velocities $v_{1,ij}$, $v_{2,ij}$.

Figure 6:
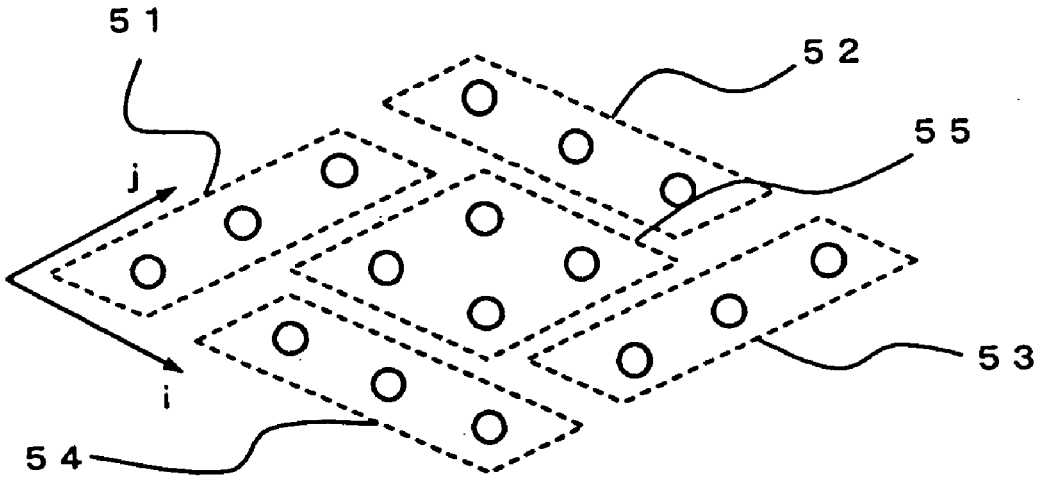
FIG. 6 shows the positional relationship between the imitation flame generating apparatus and the light sources in the embodiment.
Figure 6:
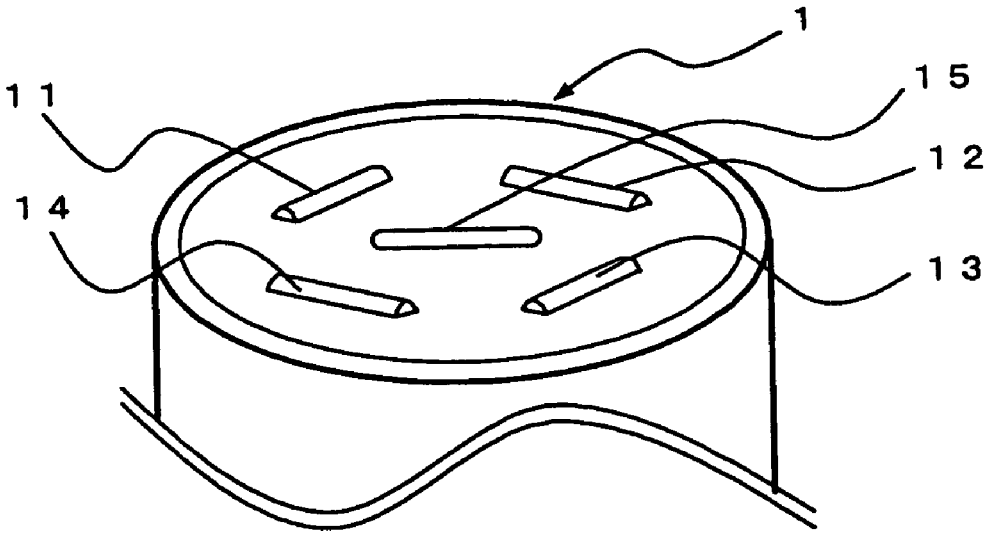

Now referring to FIG. 6, the relationship between the coupled map lattices and the arrangement of the light sources will be described. FIG. 6(*a*) shows the lattices of FIG. 5 divided into five groups. FIG. 6(*b*) shows the arrangement of five light sources corresponding to the five groups of FIG. 6(*a*). With regard to the coupled map lattices shown in FIG. 5 in which the field variables relating to the flame are given, the temperature h.sub.ij in the lattice ij is repeatedly computed using the change of the field variables relating to the coarse graining flame, which will be described later. The light sources 11 to 15 shown in FIG. 6(*b*) are turned on by output currents corresponding to the 16 temperatures h.sub.ij that are computed. Specifically, as shown in FIG. 6(*a*), the 16 lattices are divided into 5 groups, namely lattice groups 51 to 54 with three lattices each and a lattice group 55 with four lattices. The temperatures h.sub.ij possessed by each lattice in the groups are averaged, and proportional output currents are supplied to the light sources 11 to 15 (the aforementioned five light sources 10) in accordance with the averaged data. The above-described method of dividing into groups and the averaging of the individual temperatures are only examples, and any other methods may be employed as long as they are capable of associating the groups with the light sources.

As the temperature $h_{ij}$ of the lattices associated with the real space is repeatedly computed, and as the wind velocity data is also incorporated into the computations on a real-time basis, as mentioned above, the candle flame is represented by a temporal as well as spatial pattern, resulting in the reproduction of a very realistic flame.

Figure 7:
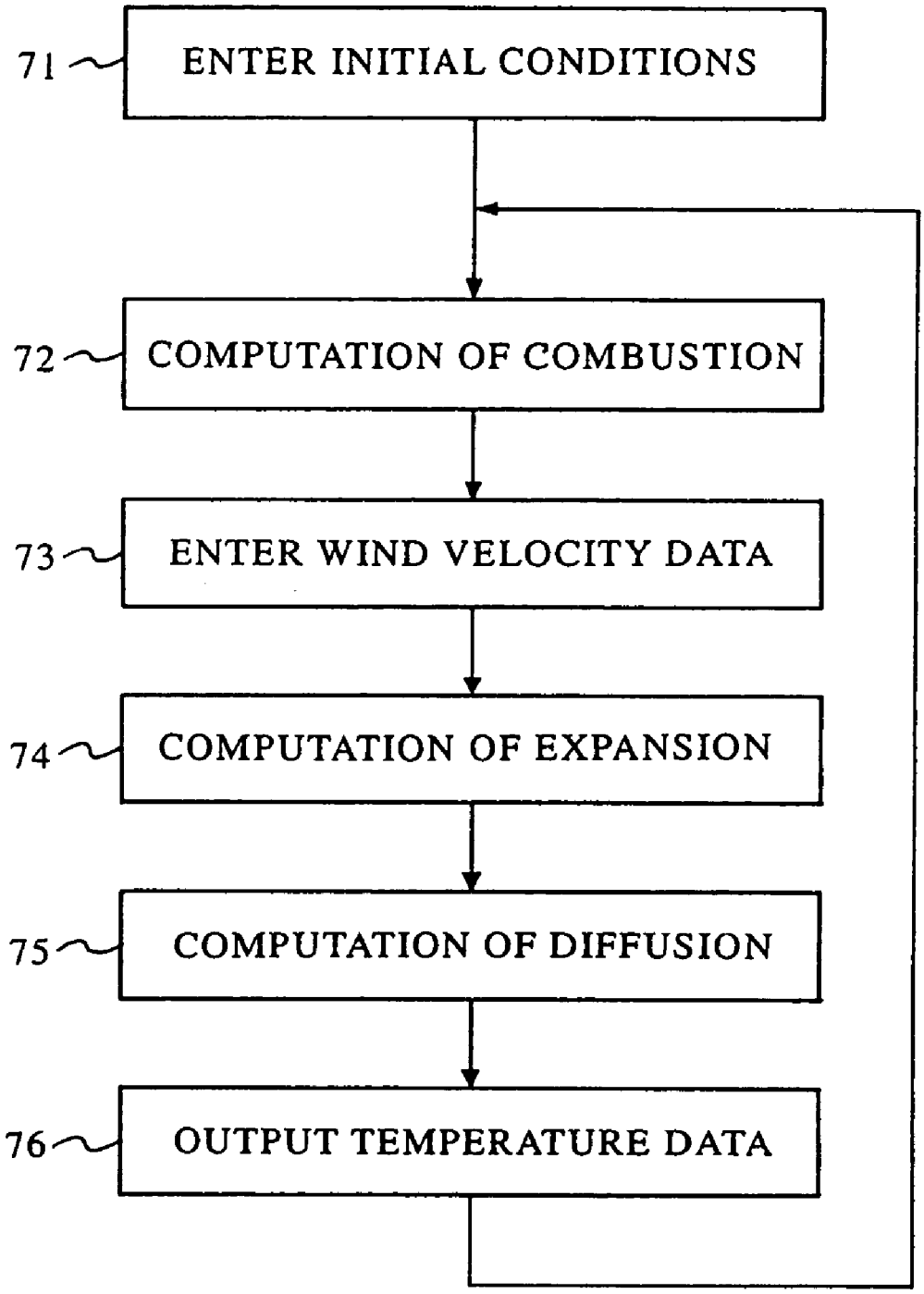
FIG. 7 shows a control flowchart of the computation performed by a control device in the imitation flame generating apparatus according to the embodiment.

FIG. 7 shows a control flowchart of the computation performed by the CPU 41*a* in the imitation flame generating apparatus 1 according to the present embodiment. This computation corresponds to the computation performed by each of the computation means 401 to 403 shown in FIG. 4, and it involves the aforementioned field variables (physical quantities) relating to the flame. The field variables relating to the flame are updated if and when necessary. The field variables relating to the flame that are not used in a relevant step are carried over to the subsequent step.

Steps 71 to 76 will be briefly described. In step 71, the field variables 45*a* relating to the flame and the control parameters 45*b* shown in FIG. 4 are entered into the CPU 41*a*, thus giving the initial conditions for the computations performed in the following steps. In step 72, the process of combustion of oxygen and fuel, with the resulting increases in vapor and carbon dioxide and the generation of heat and temperature changes, is computed for each lattice, and then the field variables are updated. In step 73, the wind velocity data 41*c* obtained via the measurement signal from the voice detection sensor 36 is entered, and the increase in the velocity field (field variable) that is entered as disturbance is added to the subsequent computation of expansion. In step 74, based on the expansion velocity produced by a change in internal energy due to the increase in step 72, a change in the field variables in each lattice is computed. In step 75, diffusion of each substance from dense to coarse is computed. In step 76, the temperature $h_{ij}$ is outputted with an appropriate timing and then converted into an output current value with which the light sources are turned on. This series of computations from step 72 through step 76 is repeated, so that the temperature $h_{ij}$ that is computed changes, and in response to this change, the output current also changes, which makes it possible to turn on the light sources in a manner resembling an actual flame. Although the processing rate in each step depends on the performance of the CPU, the process in each step generally takes from 1 to 100 ms.

The details of the computation of combustion in step 72 shown in FIG. 7 will be described. In this step, the number of instances of combustion is calculated using chemical equations of combustion, and the field variables are updated according to the thus determined number of instances of combustion.

Initially, the phenomena of combustion will be described in general terms, and a method of calculating the number of instances of combustion using combustion chemical equations will be shown below. Combustion is a chemical reaction in which hydrocarbon fuel molecules chemically bind to oxygen molecules, thereby producing carbon dioxide molecules and vapor molecules as well as generating heat and light. For example, in the case of wax as a fuel, the paraffin hydrocarbon, which is aliphatic, is generally expressed by the chemical formula $C_SH_{2S+2}$. It becomes methane $CH_4$ when s=1, and wax when s≧20 (such as eicosane $C_{20}H_{42}$, tetracontane $C_{40}H_{82}$, etc.). In general, the combustion of $C_SH_{2S+2}$ is defined by the following chemical equation:

$$\nu^1 C_S H_{2S+2} + \nu^2 O_2 \rightarrow \nu^3 CO_2 + \nu^4 H_2O \quad (1)$$

where $\nu^c$ (c=1 to 4) refers to control variables for the computation of combustion, indicating the number of moles of the fuel molecules, oxygen molecules, carbon dioxide molecules, vapor molecules, and nitrogen molecules, which are required in the combustion chemical equation. From equation (1), the combustion of eicosane $C_{20}H_{42}$, which indicates wax, is expressed by the following chemical equation:

$$2C_{20}H_{42} + 61O_2 \rightarrow 40CO_2 + 42H_2O \quad (2)$$

In a combustion according to Equation 1 (or 2), $\nu^1$ moles (2 moles) of fuel molecules and $\nu^2$ moles (61 moles) of oxygen molecules are consumed and instead $\nu^3$ moles (40 moles) of carbon dioxide molecules and $\nu^4$ moles (42 moles) of vapor molecules are produced. This reaction process proceeds in a chain-reactive manner from the moment when the temperature of the lattice ij exceeds a certain critical temperature. The process is maintained until either the fuel molecule substance amount $x_{1,\ ij}$ or the oxygen molecule substance amount $x_{2,ij}$ that exist in the lattice ij is completely consumed. When the reaction of Equation 2 is counted as one, the number of such reactions that take place (number of instances of combustion $r_{ij}$) is computed on the basis of the fuel molecule amount $x_{1,\ ij}$ and the oxygen molecule substance amount $x_{2,\ ij}$ that are given.

Specifically, using the fuel molecule amount $x_{1,\ ij}$ and the coefficient $\nu^1$ of the chemical equation, $x_{1,\ ij}/\nu^1$ is determined, while using the oxygen molecule substance amount $x_{2,\ ij}$ and the coefficient $\nu^2$ of the chemical equation, $x_{2,\ ij}/\nu^2$ is determined. Then, the number of instances of combustion $r_{ij}$ is calculated by multiplying the smaller of the above two values (the total number of instances of complete combustion) by a probability of the chemical reaction taking place. The probability of chemical reaction is determined in accordance with a constitutive equation expressed by a function of the temperature $t_{ij}$ of the lattice ij in which the characteristic parameter of chain-reaction and the aforementioned critical temperature are taken into consideration.

Based on the number of instances of combustion, the field variables relating to the flame are updated. Specifically, the substance amount consumed, the substance amount produced, and the produced energy are determined based on the number of instances of combustion $r_{ij}$, and the field variables (substance amounts) in each lattice, namely the fuel molecule substance amount $x_{1,\ ij}$, oxygen molecule substance amount $x_{2,\ ij}$, the carbon dioxide substance amount $x_{3,\ ij}$, the vapor substance amount $x_{4,\ ij}$, and the internal energy $e_{ij}$, are adjusted to update the field variables relating to the flame.

Of the field variables relating to the flame, the nitrogen molecule substance amount $x_{5,\ ij}$, the velocity $v_{1,\ ij}$ in the i-direction, and the velocity $v_{2,\ ij}$ in the j-direction do not change in this computation of combustion.

Now referring to FIG. 7, the details of step 74 for computing expansion will be described. In this computation of expansion, on the premise that the flame is a compressive fluid with the property to expand (or shrink), the following computation is performed. Namely, the substance amounts in the lattice ij are divided into four equal parts, and then computations are performed such that the thus equally divided four substance amounts and their associated internal energy $e_{ij}$ and momentum $p_{ij}$ are distributed (advected) into the lattice ij and the eight neighboring lattices (i+1j, i+1j+1, ij+1, i−1j+1, i−1j, i−1j−1, ij−1, i+1j−1; Moore-neighborhood) according to the momentum conservation law.

This computation of expansion will be described by dividing it into four sub-procedures. First, the mass, internal energy $e_{ij}$, and momentum $p_{ij}$ of each substance amount are divided. Then, based on the energy conservation law, and using the thus divided internal energy $e_{d,\ ij}$ (d=1 to 4: d indicates components of a region with the positive i-direction and the positive j-direction, a region with the negative i-direction and the positive j-direction, a region with the negative i-direction and the negative j-direction, and a region with the positive i-direction and the negative j-direction), expansion momentum (momentum which contributes to expansion) $q_{d,\ ij}$ (d=1 to 4) is calculated. And then, based on the momentum conservation law, expansion velocity $u_{d,\ ij}$ is calculated using the divided momentum $p_{d,\ ij}$ (d=1 to 4) and the previously calculated expansion momentum $q_{d,\ ij}$. Further, based on a law of distribution that employs a lever rule to be described later, distribution weights are calculated using the previously determined expansion velocity $u_{d,\ ij}$ and the field variables relating to the flame are updated. The details of these procedures will be described later with reference to FIGS. 8 to 10, and the control flow of relevant computations will also be described later by referring to FIG. 11.

Figure 8:
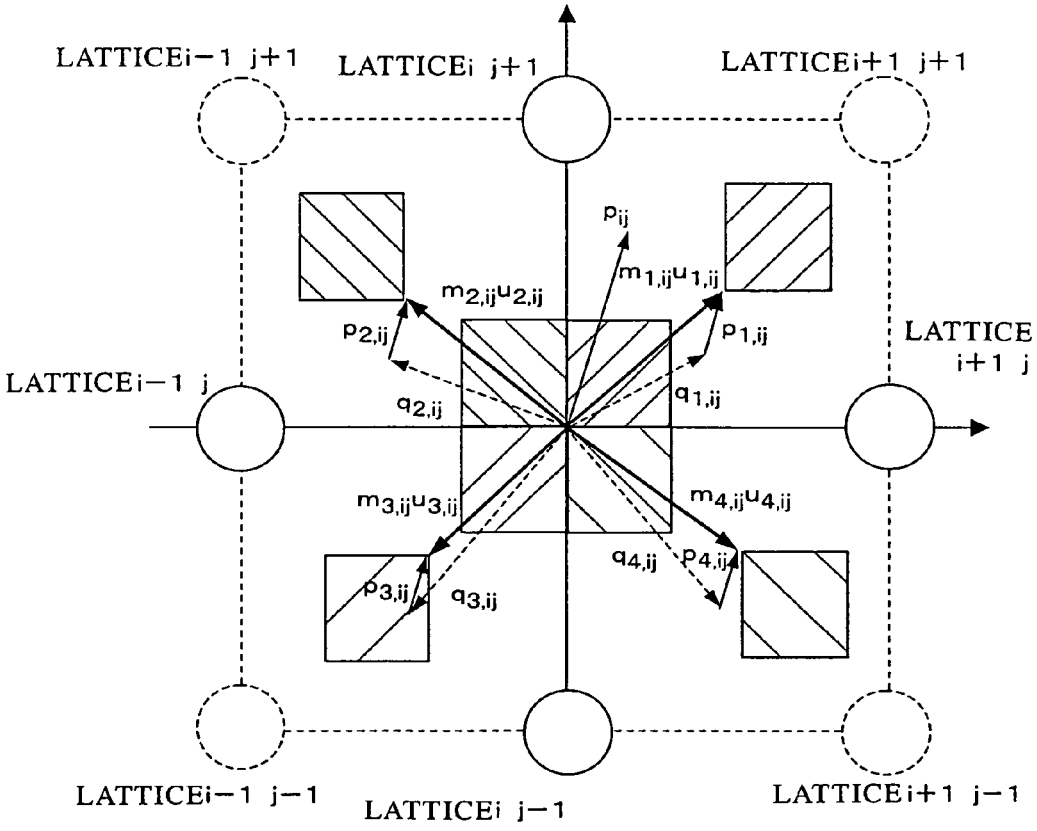
FIG. 8 shows the computation of expansion shown in FIG. 7, illustrating how the substance amounts in the lattice ij are divided.
Figure 9:
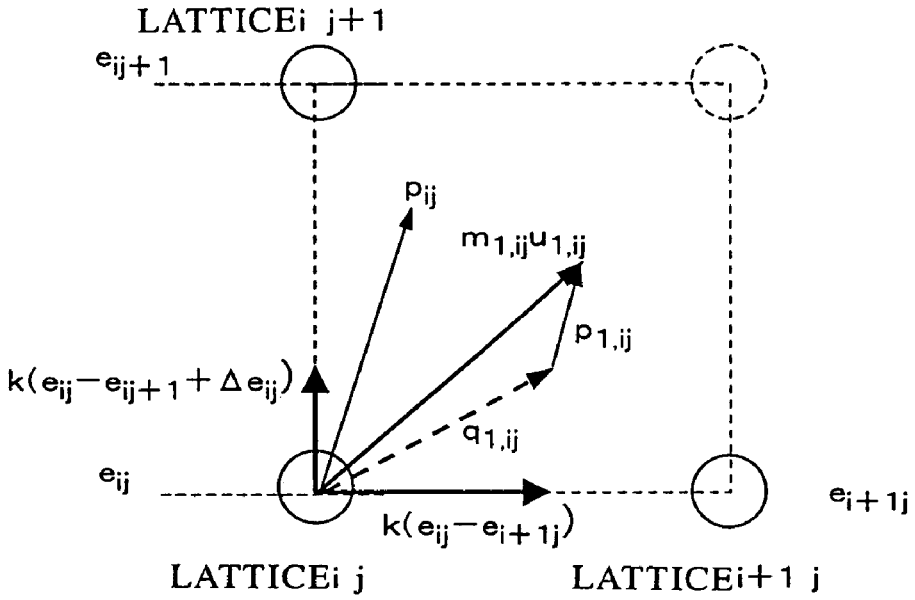
FIG. 9 shows the computation of expansion shown in FIG. 7, illustrating how the expansion velocity in a region with positive i- and j-directions of the lattice ij is calculated.
Figure 10:
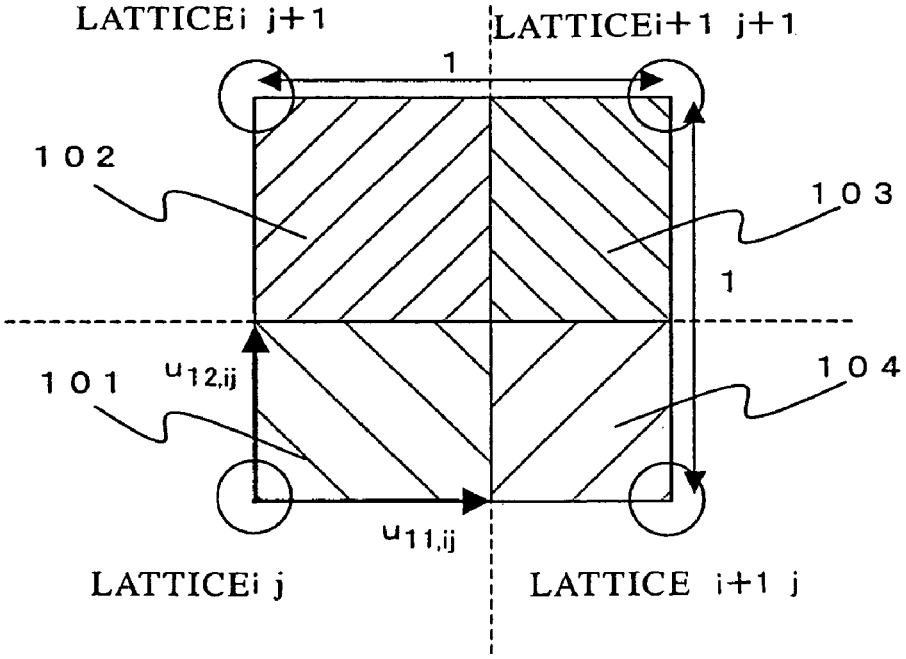
FIG. 10 shows the computation of expansion shown in FIG. 7, illustrating how distribution into surrounding lattices takes place following the generation of the expansion velocity.

Referring to FIGS. 8 to 10, the above procedures, which are part of the expansion computation, will be described. FIG. 8 shows how the substance amounts in the lattice ij are divided and how they are distributed by the expansion momentum $q_{d,\ ij}$. As shown in FIG. 8, each substance amount is equally divided into four parts. It is assumed that in the lattice ij, four expansion momenta $q_{d,\ ij}$ (d=1 to 4) are produced by the difference in internal energy between the lattice ij and the four neighboring lattices (i+1j, ij+1, i−1j, ij−1; Neumann-neighborhood). It is further assumed that these divided substance amounts move toward a region with the positive i and positive j directions, a region with the negative i and positive j directions, a region with the positive i and negative j directions, a region with the negative i and negative j directions of the lattice ij. Computations are then performed such that these divided substance amounts are distributed (expanded) to the individual lattices in dependence on the momentum $m_{d,\ ij}u_{d,\ ij}$ (d=1 to 4) composed of the divided momentum $p_{d,\ ij}$ (d=1 to 4) of the original lattice and the expansion momentum $q_{d,\ ij}$ (d=1 to 4).

The method of calculating the expansion momentum (momentum which contributes to expansion) will be described. FIG. 9 shows the method of calculating the expansion velocity in a region with the positive i and positive j directions of the lattice ij. One premise is that each substance amount moves from a lattice with a larger internal energy to a lattice with a smaller internal energy. Specifically, the i-component of the expansion momentum $q_{1,\ ij}$, which is generated from the lattice ij toward the lattice i+1j in dependence upon each internal energy, can be described as $k(e_{ij}-e_{i+1j})$ (>0), which is the energy difference times constant k. In the same manner, the expansion momentum is calculated for the region with the negative i and positive j directions, the region with the positive i and negative j directions, and the region with the negative i and negative j directions.

While the above computation is appropriate for the i-direction (the lattices in the horizontal direction), for the j-direction (the lattices in the vertical direction), the potential energy (work by the gravity) must be taken into consideration because each molecule has a mass. Namely, when the lattice ij is compared with the lattice ij+1, in addition to the internal energy difference, the potential energy must be considered because the lattice ij+1 is located vertically above. When this is considered, the previously indicated calculation formula for the horizontal expansion momentum can be corrected by the potential energy Δe according to the energy conservation law and therefore expressed as $k(e_{ij}-e_{ij+1}+\Delta e_p)$. The expansion momentum is calculated in the same manner for the region with the negative i and positive j directions, the region with the positive i and negative j directions, and the region with the negative i and j directions, with reference to the lattice ij.

From the calculated expansion momentum $q_{d,\ ij}$, the expansion velocity $u_{1,\ ij}$ for the molecules in the lattice to be distributed to the neighboring lattices is calculated. Specifically, based on the expansion velocity $u_{1,\ ij}$ and the inherent velocity of the lattice, and using the momentum conservation law, the expansion velocity $u_{11,\ ij}$ in the i-direction and the expansion velocity $u_{12,\ ij}$ in the j-direction of the expansion velocity $u_{1,\ ij}$ are calculated. The thus calculated i-direction expansion velocity $u_{11,\ ij}$ and the j-direction expansion velocity $u_{12,\ ij}$ assume values that are within the range $0 \leqq |u_{11,\ ij}|, |u_{12,\ ij}| \leqq 1$, when the magnitude of the velocity at which all the substances in the lattice of concern move to the neighboring lattices is 1. If the expansion velocities $u_{11,\ ij}$ and $u_{12,\ ij}$ do not fall within this range, they are compulsorily set to be 1.

FIG. 10 shows how the divided field variables relating to the flame are distributed to the surrounding lattices according to the i-direction expansion velocity $u_{11,\ ij}$ and j-direction expansion velocity $u_{12,\ ij}$ that have been calculated with reference to FIG. 9.

As shown in FIG. 10, in this case the magnitudes of the thus calculated i-direction expansion velocity $u_{11,\ ij}$ and j-direction expansion velocity $u_{12,\ ij}$ are within the range $0<|u_{11,\ ij}|, |u_{12,\ ij}|<1$. This means that the end points of these vectors do not correspond with each lattice. Namely, the field variables relating to the flame must be appropriately distributed to the original lattice ij and the Moore-neighborhood lattices in dependence on the magnitude of the expansion velocities except in the case where the magnitudes of the velocity vectors $|u_{11,\ ij}|, |u_{12,\ ij}|$ are zero, i.e., when the substance amounts do not move (expand) to the neighboring lattices at all, and in the case where the magnitudes of the velocity vectors $|u_{11,\ ij}|, |u_{12,\ ij}|$ are one, i.e., when the substance amounts move (expand) to all of the neighboring lattices.

The distribution of the substances in the lattices is computed based on the areas of regions 101 to 104 shown in FIG. 10. When the area of region 101 is A, that of region 102 is B, that of region 103 is C, and that of region 104 is D, $0 \leqq A, B, C, D \leqq 1$. Using these areas as molecular distribution weights (distribution ratios), C times the substance amount of the lattice ij (a quarter of the previously indicated substance amount) is distributed to the lattice ij, D times the substance amount of the lattice ij is distributed to the lattice ij+1, A times the substance amount of the lattice ij is distributed to the lattice i+1j+1, and B times the substance amount of the lattice ij is distributed to the lattice i+1j. This distribution method is referred to as a lever-rule distribution method, which is generally well known.

Figure 11:
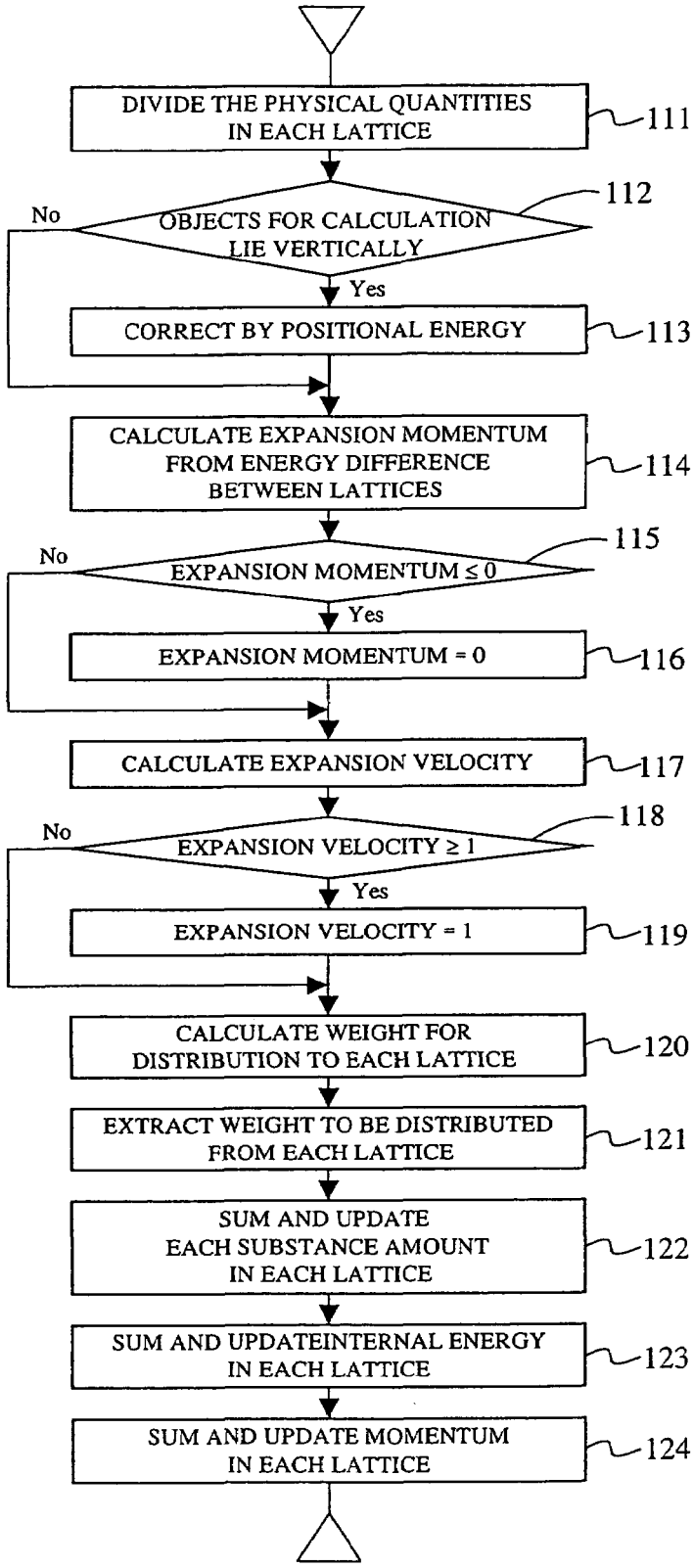
FIG. 11 shows a control flowchart illustrating the details of the computation of expansion.

FIG. 11 shows a control flowchart of the computation of expansion based on the expansion computation technique shown in FIGS. 8 to 10. In step 111, the field variables relating to the flame for each lattice are divided. In the present example, all of the field variables relating to the flame for the lattice ij are divided into four parts, as described above. Then, in step 112, it is determined whether the objects of calculation lie vertically. If they are vertically laid, the routine proceeds to step 113, where corrections are made for the potential energy (work done by the gravity) according to the energy conservation law, as mentioned above. This is followed by step 114. If the objects of calculation do not lie vertically (when they lie horizontally), the routine proceeds to step 114 without performing the corrections. In step 114, as shown in FIG. 9, the expansion momentum is calculated based on the difference in internal energy between the lattices, and then the routine proceeds to step 115.

In step 115, it is determined whether or not the expansion momentum calculated in step 114 is not more than zero. As mentioned above, this determination is for representing the movement of the substances from the lattice with a larger internal energy to the lattice with a smaller internal energy, which is a condition indicating expansion. If the expansion momentum is not more than zero, the routine proceeds to step 116. As the substances are not moving from a larger internal-energy lattice to a smaller internal-energy lattice, or the direction is opposite, it is determined that the expansion momentum=0, and the routine then proceeds to step 117. On the other hand, if the expansion momentum is more than zero, the routine proceeds to step 117 from step 115.

In step 117, the expansion velocities $u_{d1,\ ij}$ and $u_{d2,\ ij}$ (d=1 to 4) are calculated using the momentum conservation law, as described above. This is followed by step 118, where it is determined whether the magnitudes of the expansion velocities $|u_{d1,\ ij}|, |u_{d2,\ ij}| \geqq 1$. If this condition is satisfied, the routine proceeds to step 119 where it is determined that the magnitudes of the expansion velocities $|u_{d1,\ ij}|, |u_{d2,\ ij}|=1$ before proceeding to step 120. If the condition is not satisfied, the routine proceeds to step 120.

In step 120, the weights with which the field variables relating to the flame for the lattice ij are to be distributed to the neighboring lattices are calculated using the expansion velocities $u_{d1,\ ij}$ and $u_{d2,\ ij}$, according to the lever-rule distribution method, as shown in FIG. 10. In step 121, based on the weights calculated in step 120, the weights to be distributed to the lattice ij from the neighboring lattices are extracted. In step 122, using the thus extracted weights, the individual substance amounts distributed to each lattice are summed and updated. In step 123, the internal energy is summed and updated by incorporating the work by the gravity in accordance with the energy conservation law.

Then in step 124, the momenta distributed in each lattice are also summed and updated, in accordance with the momentum conservation law.

Now referring to FIG. 7, the details of the computation of diffusion in step 75 will be described. This diffusion is different from the action of the expansion (or shrinking) previously indicated and is considered in terms of a phenomenon that takes place on the level of the molecular motion of each substance. This phenomenon represents the diffusion of molecules in an attempt to achieve homogeneity in a space where molecular density differences are present. Specifically, because there are irregularities in the density of the molecules distributed in each lattice due to the post-combustion expansion, computations are performed to capture the phenomenon in which the density irregularities of the adjacent molecules become uniformly diffused.

Thus the computation of diffusion is performed by distributing certain amounts of the field variables relating to the flame in ij and their associated internal energy $e_{ij}$ and momentum $p_{ij}$ from the lattice ij to the Neumann-neighborhood lattices, regardless of their internal energy differences.

Figure 12:
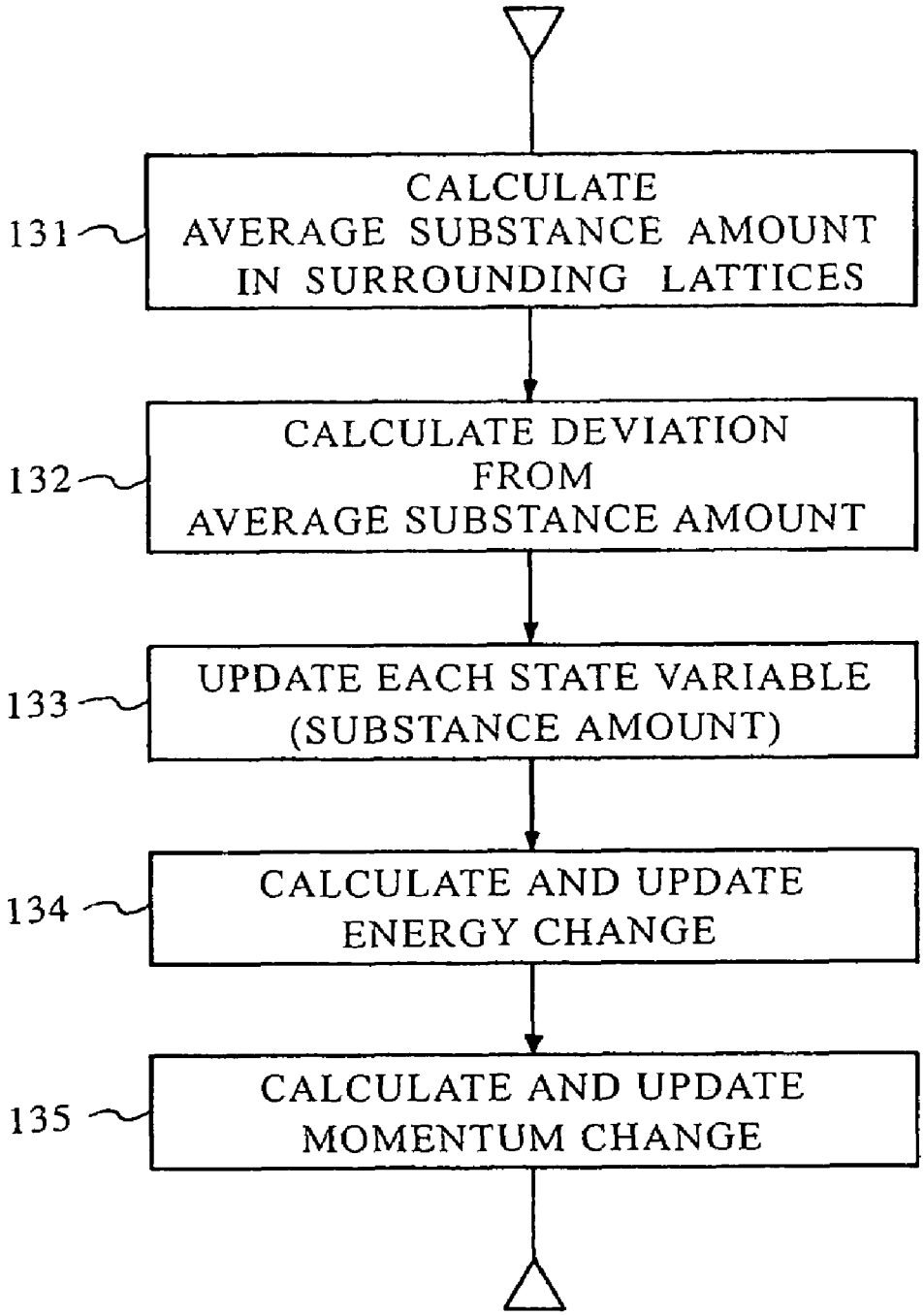
FIG. 12 shows a control flowchart illustrating the details of the computation of diffusion.

FIG. 12 shows a control flowchart of step 75 for the computation of diffusion shown in FIG. 7. In step 131, the average substance amount for the lattices surrounding the lattice of concern is calculated. In step 132, a deviation between the lattice of concern and the average substance amount is determined. This is for the purpose of determining a molecular density ratio of the lattice of concern to the surrounding lattices. The greater the deviation, the diffusion is more likely to occur.

The routine then proceeds to step 133 where, based on the deviation, the field variables relating to the flame for the lattice of concern are updated such that the substance amounts for the lattice of concern and for the surrounding lattices become uniform. In step 134, a deviation from an average value having as variables the temperatures that are distributed along with the substance amounts is calculated in the same method employed in the previous steps 131 and 133. By adding the work performed by gravity, the deviation value is updated in accordance with the energy conservation law. Then in step 135, a deviation from an average value having as variables the velocities that are distributed along with the substance amounts is calculated in accordance with the momentum conservation law, using the same method as in step 135. The values of the deviation, namely the i-direction velocity $v_{1,\ ij}$ and the j-direction velocity $v_{2,\ ij}$, are updated.

Thus the computations are based on a dynamic thermal-hydraulic phenomenon, the light sources can be turned on in a manner that more closely approximates the real flame. Moreover, because the computations are performed continuously, changes in external environments can be incorporated. It is also possible to modify the conditions of the flame in accordance with the user's preferences in a real-time manner.

While the invention has been particularly shown and described with reference to preferred embodiments thereof, it will be understood by those skilled in the art that various changes can be made without departing from the spirit and scope of the following claims.

For example, while the outside-air changes have been detected using the voice detection sensor, various other sensors, such as airflow sensors and temperature sensors, may be employed individually or in combination as long as they are capable of measuring the condition of outside air surrounding the imitation flame generating apparatus.

While the computation means for computing the change of the field variables relating to the flame has been described with reference to FIG. 4, the relevant computation may be performed in other ways than has been described. For example, a circuit representing other phenomena of the flame may be added. The computation procedure as shown in the flowchart of FIG. 7 may also be modified by partly changing the order of the sequence, for example, and yet it is still possible to reproduce the flame without any problems. Moreover, the chemical reaction formula for the fuel may be appropriately selected in accordance with the substances used for combustion. The distribution method based on the lever rule, which has been used for diffusion, may also employ a probability distribution for determining the distribution ratio. These computations may be performed externally in advance, stored in a memory device, and then read therefrom.

While in the above-described embodiments a single flame of a candle has been reproduced, it is also possible to express a plurality of flames using a single control device. By selecting the number of the light sources used, their colors and arrangements, and/or by resetting the coefficients of the model, a plurality of flames that exist in the case of the combustion of firewood or in a building on fire, for example, may be expressed. It will also be understood by those skilled in the art that the flow of gas produced during combustion may be reproduced together with the reproduced flame.

What is claimed is:

1. An imitation flame generating apparatus comprising a light source and a control device for controlling the output of an electric current to said light source, wherein said control device comprises computation means for computing a spatiotemporal pattern of a flame using a coupled map lattice, wherein said coupled map lattice comprises a field variable relating to an appropriately coarse graining flame, and output means for outputting said electric current based on the thus computed spatiotemporal pattern of a flame, wherein said computation means comprises a procedure for computing said field variable relating to said flame using a control parameter.

2. The imitation flame generating apparatus according to claim 1 wherein said field variable relating to said flame comprises a substance amount, an internal energy amount, and a momentum, and said computing procedure comprises a procedure for computing combustion, a procedure for computing expansion, and a procedure for computing diffusion.

3. The imitation flame generating apparatus according to claim 2 wherein said computing means computes said spatiotemporal pattern of the flame based on said combustion computation procedure, said expansion computation procedure, and said diffusion computation procedure.

4. The imitation flame generating apparatus according to claim 3 wherein said computation means is capable of inputting and changing said field variable relating to the flame and/or said control parameter.

5. An imitation flame-generating method for generating an imitation flame by controlling an electric current supplied to a light source, said method comprising computing a spatiotemporal pattern of a flame for generating an imitation flame using a coupled map lattice, wherein said coupled map lattice comprises a field variable relating to an appropriately coarse graining flame, and supplying the output current in accordance with the thus computed spatiotemporal pattern of a flame to turn on said light source, wherein said computation comprises a procedure for computing said field variable relating to the flame using a control parameter.

6. The imitation flame-generating method according to claim 5 wherein said field variable relating to the flame comprises a substance amount, an internal energy amount, and a momentum, and said computing procedure comprises a procedure for computing combustion, a procedure for computing expansion, and a procedure for computing diffusion.

7. The imitation flame-generating method according to claim 6 wherein said computation involves the computation of said spatiotemporal pattern of the flame using said combustion computation procedure, said expansion computation procedure, and said diffusion computation procedure.

8. The imitation flame-generating method according to claim 7 wherein said field variable relating to the flame and/or said control parameter can be inputted and changed during said computation.

* * * * *